United States Patent [19]

Singer et al.

[11] Patent Number: 4,657,787

[45] Date of Patent: Apr. 14, 1987

[54] FLOW COATING OF METALS

[75] Inventors: Alfred R. E. Singer; Walter N. Jenkins; Asgar M. H. Alibhai, all of Swansea, Wales

[73] Assignee: National Research Development Corporation, London, England

[21] Appl. No.: 760,983

[22] Filed: Jul. 31, 1985

[30] Foreign Application Priority Data

Aug. 15, 1984 [GB] United Kingdom ..... 8420699

[51] Int. Cl.[4] ..... C23C 4/18

[52] U.S. Cl. ..... 427/319; 427/320; 427/321; 427/422

[58] Field of Search ..... 427/319, 320, 321, 422, 427/191, 192

[56] References Cited

U.S. PATENT DOCUMENTS

| | | | |
|---|---|---|---|
| 1,455,862 | 11/1976 | Singer . | |
| 3,198,662 | 8/1985 | Seibert . | |
| 3,909,921 | 10/1975 | Brooks | 29/527.2 |
| 3,996,398 | 12/1976 | Manfredi | 427/320 |
| 4,420,441 | 12/1983 | Singer | 264/7 |
| 4,477,291 | 10/1984 | Singer . | |

FOREIGN PATENT DOCUMENTS

| | | | |
|---|---|---|---|
| 2461730 | 7/1975 | Fed. Rep. of Germany | 427/320 |
| 2615022 | 7/1977 | Fed. Rep. of Germany . | |
| 0097460 | 7/1980 | Japan | 427/320 |
| 5712 | of 1910 | United Kingdom . | |
| 965438 | 7/1964 | United Kingdom . | |
| 1117554 | 6/1968 | United Kingdom . | |
| 2115014 | 9/1983 | United Kingdom . | |

OTHER PUBLICATIONS

IBM Technical Disclosure Bulletin, vol. 15, No. 8, Jan. 1973, p. 2657, New York, U.S.; J. N. Cole et al: "Applying Conductive Patterns on Substrates".

Patents Abstracts of Japan, vol. 6, No. 250, (C-139) [1128], 9th Dec. 1982; JP-A-57 145 970 (Shin Nippon Seitetsu KK) 9-9-82.

*Primary Examiner*—Sam Silverberg

*Attorney, Agent, or Firm*—Cushman, Darby & Cushman

[57] ABSTRACT

Aluminum is flow-coated onto ferrous strip by reducing the hot strip in hydrogen, cooling it to 650°-680° C. in nitrogen and spraying molten aluminum on it such that the aluminum splats flow into each other but solidify in 0.2-0.5 seconds. The aluminum is bonded to the strip through an intermetallic layer less than quarter of the total coating thickness, the aluminum having a cast structure.

5 Claims, 1 Drawing Figure

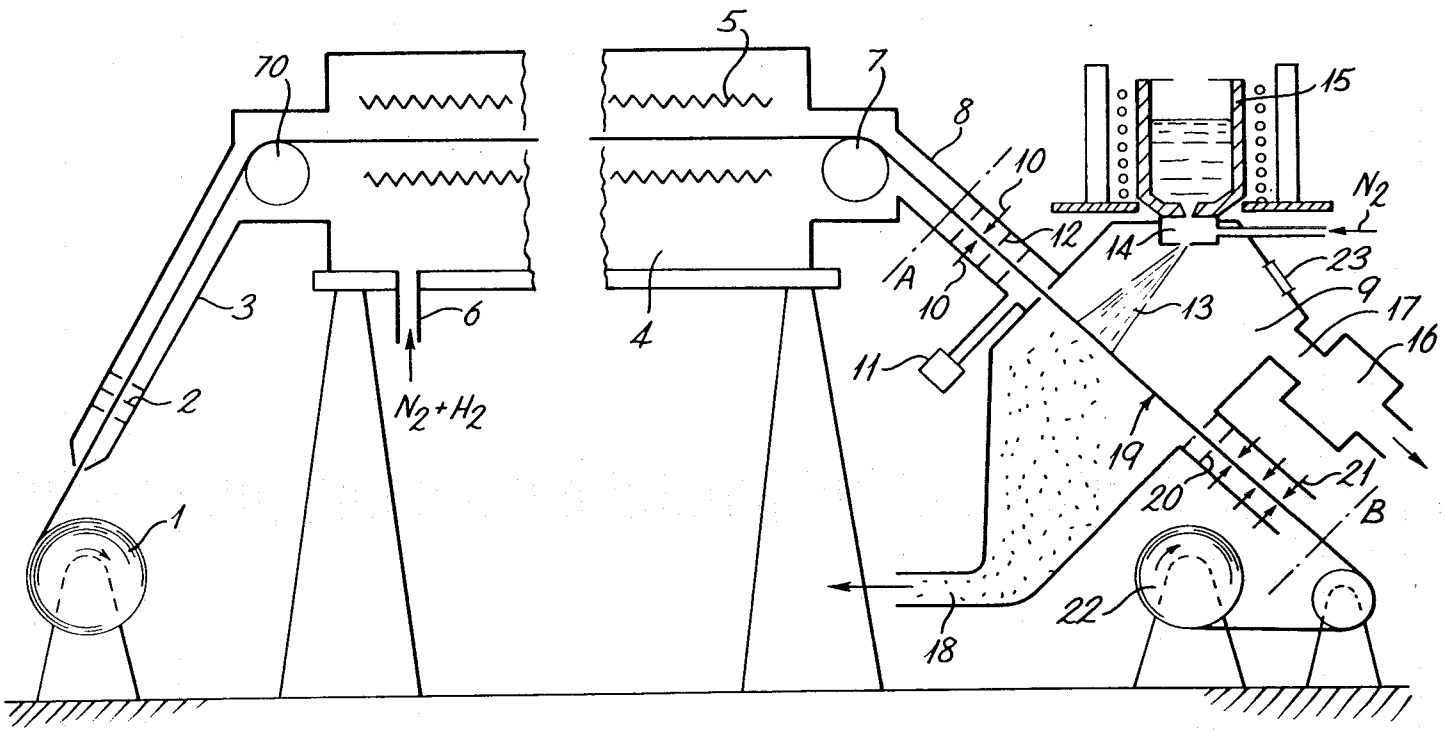
$N_2$
$N_2+H_2$

FLOW COATING OF METALS

This invention relates to coating a metal by applying a molten coatant metal to fit. The technique will conveniently be called 'flow coating'.

Metallic coatings are widely used on steel products for improving corrosion resistance. From a manufacturing point of view they can be divided mainly into two groups, according to thickness: (a) up to a few microns, and (b) 10 microns upwards. The best known product in (a), which typically includes vapour deposition and electrodeposition, is tin plate made by electrodeposition and flow melting, in which the tin coating is usually 1 or 2 microns in thickness. Steel strip coated with a very thin matt tin electrodeposit at room temperature is heated in air to above the melting point of tin, whereupon the coating melts and flows together to produce a smooth coating with a bright finish. This is called flow melting because the tin is deliberately melted. However, aluminium cannot be flow melted as can tin, because a tenacious oxide film forms on the aluminium particles, preventing them from coalescing or flowing. A similar situation occurs with Zn or Zn/Al alloy coatings.

Group (b), thicker coatings of 10 microns upwards, are usually made by hot dipping, metal spraying or roll bonding. Their behaviour in corrosive environments is far better than for thin coatings. The best known example is hot dipped galvanised steel strip in which the coating is usually in the region of 20–40 microns thickness. Hot dipped galvanised, aluminised or Al/Zn coated steel strip is made in large tonnages, typically in continuous plants operating at speeds up to 150 m/min in which the natural oxide on the surface of steel strip is first removed by passing through a reducing atmosphere at high temperature after which the strip is run, while still in a protective atmosphere, directly into and through a bath of molten coating metal. The coating metal wets the hot oxide free steel surface and adheres to it. After cooling the coating—usually double sided—is found to be metallurgically bonded to the steel.

The main difficulty with these hot dipped products is that during hot dipping, in which the strip is necessarily at a temperature not less than the bath of molten metal, considerable diffusion takes place with detriment to the product. Diffusion of Fe into the Zn or Al layer gives rise to brittle intermetallic compounds at the interface which cause a serious loss of ductility. Although it is known to add silicon to aluminium to inhibit Fe-Al intermetallic formation, the silicon also causes some loss of ductility as well as some loss of corrosion resistance. In coating steel with copper by this method, copper diffuses along the grain boundaries of the steel, leading to intergranular weakness.

Coating by metal spraying is frequently used for large static structures. A wide range of coating metals and alloys can be used but the most frequently used are Zn and Al. In these cases it is usual to grit blast the steel structure to clean the surface, remove heavy scale and roughen the surface after which the surface is spray coated in air with metal using fuel gas, arc plasma or arc spray equipment. It is important to note that these spray coatings are relatively porous and contain oxide. They are not metallurgically bonded on to the steel base because bonding is impeded by thin oxide coatings remaining on the steel strip after grit blasting. As a consequence, the coating is held on to the strip mainly by mechanical bonding to the roughened grit blasted surface. The ductility of the coatings is very low because of the poor bonding and the inherent brittleness of the spray deposit. Little or no alloying with the base metal occurs.

Where it has been suggested to spray aluminium onto a warmed steel substrate, as in GB Patent Publication No. 2115014, the temperature of the substrate is only 200°–500° C.

By contrast the process of the invention enables metallurgically bonded products to be manufactured which have greater ductility, a thinner layer of intermetallics and improved external appearance compared with the conventional product. The coatings can also be single sided or double sided as required.

The invention comprises a process for making a metal-coated product in which the coating metal is applied to the base product in the form of a spray of molten atomised (preferably gas-atomised) particles, the base product presented to the spray having a surface free from oxide and being at a temperature in the region (e.g. within 5% on the absolute temperature scale) of the melting point of the coating metal, such that the liquid splats formed by the spray impacting the base product fuse together to form a smooth flowed coating which on subsequent cooling gives a fully dense metallurgically bonded product, said cooling preferably being rapid enough to freeze the coating at any given point within 1 second of the impact of the first liquid splat.

By this process, certain new products can be obtained, for example ferrous strip coated with aluminium bonded to the strip through an intermetallic layer less than quarter of the total coating thickness, the aluminium having a cast structure even with little or no silicon. Formerly, silicon would have had to be added to mofify the structure of the aluminium so that it would resemble a cast structure or to inhibit intermetallic formation.

The metal coating may consist of a pure metal or it may be an alloy. In the latter case the melting point referred to would be the liquidus of the alloy, the minimum temperature of the base product surface being such that the molten alloy splats flow into their neighbours. The spray of molten atomised particles may be produced by any suitable method but a particularly effective one is gas atomising, preferably using an inert gas, preferably at substantially room temperature. In this case the molten atomised particles are at a much higher temperature than the surrounding atomising gas. The cooler gas plays an important role in the process because it impinges on the hot product during and after the coating process so causing a rapid fall in the surface temperature of the product subsequent to coating while still in the protective atmosphere generated by the atomising gas. This in its turn diminishes intermetallic and alloy formation at the interface, grain boundary diffusion of the coatant into the base product and related effects, thus yielding a more ductile and improved product.

While the process of the invention can apply to any metal combination in which the coating metal has a lower melting point than the base it is particularly important from a commercial point of view in the case of Zn, Al or Zn/Al coatings on steel strip produced continuously. For the purposes of explanation and illustration these products will be the only examples used although it must be clearly understood that the process is suited also for the manufacture of other coated products such as copper-coated steel whether made continuously, semi-continuously, or singly or in batches.

It is useful to consider the differences between conventional hot dipping and the present invention. Typically, in the process of the invention, clean smooth as-rolled mild steel strip is passed through a furnace heated to a high temperature, say, between 700° C. and 800° C., in an atmosphere consisting of $N_2$ and $H_2$. The natural oxide on the smooth as-rolled surface of the strip is reduced to iron before it passes into a cooling chamber where jets of $N_2$ cool it to a temperature between, say, 680° and 650° C. if pure aluminium (melting point 660° C.) is being used as a coating metal. The strip then passes, still under inert atmosphere, into the spray chamber where a spray of molten atomised aluminium droplets is directed at one surface to produce a uniform coating. The droplets of molten metal splat on the steel surface and wet it because no oxide is present. They do not freeze immediately. Instead they stay liquid for many tens of milliseconds, because the steel is approximately at the melting point of the aluminium. This enables them to first fuse together to form a relatively smooth uniform and dense coating. The spreading action of splatting of any one droplet of Al typically takes less than one millisecond and the first layer of splats is laid down on the steel strip in a few tens of milliseconds. The full thickness of coating takes perhaps 0.1 sec to form. The atomising gas surrounding the particles is at a much lower temperature and therefore cools the surface of the strip rapidly thus freezing the molten film formed on the strip. Thus a smooth flowed coating which wets the surface of the steel is formed very rapidly aided by the high gas velocity on the surface which assists the flowing process. At the same time the relatively cold atomising gas cools the coated steel strip so that solidification is complete between 0.2 and 0.5 sec. This gives very little time for intermetallic or alloy formation at the interface. Consequently the thickness of the intermetallic or alloy layer is less than that produced by conventional hot dipping where the steel strip is in contact with molten aluminium for 2 or 3 seconds. In the case of aluminium coated steel, although it is advisable to continue rapid cooling until the temperature is below 550° C. or even 500° C. to avoid further growth of the alloy layer just as a similar precaution is taken with conventional hot dipped products, the diffusion rate of the aluminium falls dramatically when it freezes. Similarly with Zn and Zn/Al alloy coatings although the temperatures are different. In general rapid cooling is desirable at least down to 90–85% of the coatant melting point on the absolute temperature scale.

In the process of the invention the coating is not melted on the strip surface; it is already molten and the molten splats simply flow together to form a smooth coating. To differentiate, it has been called flow coating rather than flow melting. A further difference, already explained in the discussion relating to tinplate, is that flow coating cannot be imitated by first spray coating and subsequently heating in air to fuse the coating.

Other advantages of flow coating are that thinner coatings can be obtained than with dip coating, and that it uses less energy than dip coating because the need to maintain a large, say 40 tonne, bath of molten metal is avoided. Also the operation can be started and stopped at a moment's notice without danger of solution of the steel strip in the bath of molten metal such as happens when the strip is stationary in the conventional process.

Although any method of atomising may be used, a convenient one is gas atomising. It can provide the flow of inert gas for cooling and also aids the flattening and flow of the liquid splats. The oxygen content of the atomising gas should be kept low, preferably less than 100 p.p.m. A fine spray is especially beneficial because uniform coverage can more easily be obtained.

Several methods of gas atomising can be used for the process of the invention and this includes arc spray where the coating metal is usually in the form of wire. This is advantageous if relatively small areas of coating are involved. In most other cases the gas atomising of a melt is preferred because it is more economical. The use of arc plasma fed with powder produces flow coating but does not provide sufficiently rapid cooling to avoid the formation of thick intermetallic or alloy layers at the interface. Fuel gas atomising suffers from the same problems but is even less favourable because oxygen is necessarily introduced into the spray chamber with bad effect on both adhesion and flowing.

Both single sided and double sided coatings can be made by the process. If required one side can be thicker, and/or of a different coatant, than the other. This is governed by the rate at which deposition occurs and the speed of the strip.

Whenever large areas have to be covered by a spray to give a uniform deposit it is usually necessary to have some form of scanning either of the spray or the product. In the case of strip clearly a scanning nozzle is preferred and in this invention a suitable scanning nozzle is that described in British Pat. No. 1455862.

Control over the process is mainly concerned with the temperature at which the strip is presented to the spray. If the temperature is too high flow will occur but freezing will take so long that there will meanwhile be alloying, leading to an unsatisfactory product with thick alloyed layers at the interface. In the case of aluminium such temperatures are above about 700° C. (=melting point +5%). If the temperature is too low the coating will adhere but will freeze before it has had sufficient chance to flow, leading to a rough surface and some cracking on bending. Such temperatures with aluminium are below about 620° C. (=melting point −5%). The precise temperature within this range for optimum results will be influenced by the temperature, pressure and quantity of the atomising gas. High gas temperatures tend to give more alloying, whereas low gas temperatures, high gas pressures and large quantities of atomising gas give less alloying.

The invention will now be described by way of example with reference to the accompanying drawing, which shows schematically apparatus performing a process according to the invention.

The example is a plant capable of coating 1 m wide steel strip with 20 microns of Al at 50 m/min. The part lying between A and B is of most interest in the context of the invention.

In the drawing, mild steel strip 0.80 mm thick and 1 m wide is uncoiled at 1 and passes upwards through baffles 2 in a duct 3 over an insulated roller 70 at a speed of 50 m/min into a reducing furnace 4. There, the strip is heated to a temperature of 750° C.±100° C. by electrical resistance elements 5 in a reducing atmosphere (50% $H_2$+50% $N_2$) fed into the furnace 4 through a port 6. The strip passes over an insulated roller 7 and downwards through a duct 8 into a spray chamber 9. Between the insulated roller 7 and the spray chamber 9 jets of cold nitrogen 10 impinge on the strip to lower its temperature to 680° C.±10° C. An optical pyrometer 11 is used to determine the temperature of the strip immediately before it enters the spray chamber 9 after passing through a series of baffles 12. A spray of atomised molten aluminium droplets 13 is directed onto the top surface of the strip from an atomising and scanning nozzle 14 as described in British Pat. No. 1455862, arranged to deflect the spray to scan always in the plane normal to the direction of movement of the strip. The nozzle 14 is fed by a vertical stream of molten aluminium from a heated holding vessel 15 (at 700° C.) which is topped up from a nearby melting furnace (not shown) in order to maintain a reasonably constant head of molten metal in the container. The spray scans the strip at 50 cycles per second using approximately 6 kg/min of Al and 2 kg/min of nitrogen atomising gas. The gas, as it is conducted to the nozzle 14, is at room temperature and at a pressure of 15 kN $m^{-2}$. The main outflow of spent gas is through a filter 16 in the port 17 above the strip. Overspray powder and excess gas is extracted through a port 18 below the strip. The baffles 12 effectively prevent atomising gas from entering the duct 8 and in fact excess gas is made to move through the baffles 12 into the spray chamber 9 by maintaining a pressure in the furnace chamber 4 slightly in excess of the pressure in the spray chamber 9. The spray deposit flows on the strip surface to form a very thin molten layer which is subsequently cooled by the atomising gas (perhaps now at about 100°-300° C.) passing over it so that it solidifies at a point approximately indicated by 19. Optional cooling gas jets (not shown) may be directed at the underside of the strip at or near this point. The strip continues to be cooled rapidly to below 550° C., thus substantially arresting diffusion of aluminium into the iron. The strip passes through a further set of baffles 20 with further cooling jets 21 to a coiler 22 which is used to draw the strip through the plant.

The various process parameters, especially relating to temperature, are interrelated. Control of the process is achieved mainly by altering the pressure of gas at the cooling nozzles 10 to ensure that the correct temperature is being maintained as measured by the radiation pyrometer 11. A typical consumption of gas at 10 is half the flow of the atomising gas (14), at room temperature or lower. A further check can be made by viewing the top surface of the strip through the viewing port 23. The top surface should be bright i.e. molten under the spray as far as the point 19, where it becomes matt because of solidification. If that point travels further towards the exit the strip is too hot, and vice versa, and the cooling jets 10 should be adjusted. Instead, the temperature of the reducing furnace 4 or the speed of the strip or the pressure of the atomising gas could be adjusted, but each of these influences other factors such as the degree of reduction of oxides, the thickness of the coating and the degree of atomisation respectively. It is best therefore to fix these at appropriate values and to control mainly with the cooling jets 10.

The strip emerging from the plant has a coating 20 microns thick including an intermetallic layer approximately 3 microns thick at the interface. The surface is smooth and the ductility, measured by bend testing, is excellent for this class of material. The strip may be, but need not be, cold rolled or hot rolled.

Similar equipment can be used for Zn and Zn/Al alloy coating, with the temperatures appropriately adjusted.

Any form of heating may be used in the reducing furnace 4 provided always that the furnace atmosphere will reduce the oxide of the strip metal and that an oxygen content of less than 100 p.p.m. is maintained in the spray chamber 9. A particularly useful form of heating (already used in certain plants) is resistance heating of the strip itself, especially in conjunction with a different form of heating of the reducing furnace 4, to provide close control of the temperature of the strip within the chamber 9.

We claim:

1. A process for making a metal-coated product, comprising:

applying a coating metal to a metal base product in the form of a spray of molten atomised metal particles, the coating metal having a lower melting temperature than the base product, the base product presented to the spray having a surface free from oxide and being at a temperature which, on an absolute temperature scale, is within 5% of the melting point of the coating metal, such that the liquid splats formed by the spray impacting the base product fuse together to form a smooth flowed coating; gas cooling the base product and the thus-coated product while and after applying the coating at such a rapid rate as to freeze the coating at any given site on the product within one second of the impact of the first liquid splat at such site so as to inhibit coating/base product intermetallic and alloy formation and obtain a fully-dense metallurgically-bonded product.

2. A process according to claim 1, wherein the coating metal is aluminium or zinc or an aluminium-zinc alloy and the base product is ferrous.

3. A process according to claim 1, wherein the said subsequent cooling is rapid enough to freeze the coating at any given site within from 0.2 to 0.5 seconds of the impact of the first liquid splat at such site.

4. A process according to claim 1, wherein the atomised particles are gas-atomised particles.

5. A process according to claim 4, wherein the atomising gas is substantially at room temperature.

* * * * *